US007761028B2

(12) United States Patent
Oguma et al.

(10) Patent No.: US 7,761,028 B2
(45) Date of Patent: Jul. 20, 2010

(54) DEVELOPING APPARATUS, PROCESS CARTRIDGE AND MAGNETIC SEALING MEMBER

(75) Inventors: Toru Oguma, Mishima (JP); Shinichi Nishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 690 days.

(21) Appl. No.: 11/608,355

(22) Filed: Dec. 8, 2006

(65) Prior Publication Data

US 2008/0112723 A1 May 15, 2008

(30) Foreign Application Priority Data

Nov. 15, 2006 (JP) ..... 2006-309230

(51) Int. Cl.
*G03G 15/08* (2006.01)

(52) U.S. Cl. ..... 399/104; 399/103

(58) Field of Classification Search ..... 399/103, 399/104

See application file for complete search history.

(56) References Cited

U.S. PATENT DOCUMENTS

| | | | | |
|---|---|---|---|---|
| 5,790,923 | A | 8/1998 | Oguma et al. | 399/106 |
| 6,021,291 | A | 2/2000 | Karakama et al. | |
| 6,266,500 | B1 * | 7/2001 | Numagami et al. | 399/104 |
| 6,606,469 | B2 | 8/2003 | Kikuchi et al. | |
| 6,970,667 | B2 | 11/2005 | Watanabe et al. | |
| 2004/0001727 | A1 * | 1/2004 | Akutsu | 399/104 |
| 2004/0126130 | A1 | 7/2004 | Watanabe et al. | |
| 2006/0067730 | A1 * | 3/2006 | Uratani et al. | 399/104 |

FOREIGN PATENT DOCUMENTS

| | | | |
|---|---|---|---|
| JP | 9-218578 | A | 8/1997 |
| JP | 11-143224 | A | 5/1999 |
| JP | 11-167284 | | 6/1999 |
| JP | 2000-275965 | | 10/2000 |
| JP | 2004-151228 | A | 5/2004 |
| JP | 2005-215439 | A | 8/2005 |

* cited by examiner

*Primary Examiner*—David P Porta
*Assistant Examiner*—Milton Gonzalez
(74) *Attorney, Agent, or Firm*—Fitzpatrick, Cella, Harper & Scinto

(57) ABSTRACT

A developing apparatus for an image forming apparatus includes a magnetic sealing member having an arcuate surface and having a magnetic property, and which is opposed to an outer surface of a developing roller with a gap therebetween and a projected surface having a magnetic property projected from an upstream end of the arcuate surface toward upstream with respect to a peripheral moving direction of the developing roller, and which is more remote from an outer surface of the developing roller than the arcuate surface; and a sheet for preventing the magnetic developer from leaking between the developing device frame and the developing roller. The sheet is mounted to an upstream end of a developing device frame with respect to the moving direction and contacted to the developing roller so as to cover at least a part of the projected surface.

9 Claims, 10 Drawing Sheets

DEVELOPING APPARATUS, PROCESS CARTRIDGE AND MAGNETIC SEALING MEMBER

FIELD OF THE INVENTION

The present invention relates to an electrophotographic type image forming apparatus, a developing device therefor, a process cartridge to be mounted to a main assembly of the image forming apparatus and a magnetic sealing member therefor.

DESCRIPTION OF RELATED ART

Here, the electrophotographic type image forming apparatus is an image forming apparatus for forming an image on a recording material, such a recording paper, OHP sheet, textile or the like, through an electrophotographic image forming process. It includes an electrophotographic copying machine, an electrophotographic printer, an electrophotographic printer type facsimile machine or the like.

The process cartridge is a unit containing at least developing means and electrophotographic photosensitive member as a unit which is detachably mountable to the main assembly of the electrophotographic image forming apparatus.

In conventional developing devices used in an image forming apparatus for forming an image on a recording material through the electrophotographic image forming process, a developer carrying member such a developing roller is rotatably supported on a developing device frame. In such a developing device, there is provided a sealing member for preventing leakage of the toner from the developing device frame. In a conventional developing device using magnetic toner, a known sealing member is a magnet disposed with a fine gap from the outer surface of the developing roller at each of the opposite ends of the developing roller, and the toner existing in the gap therebetween is retained by the magnetic force so as to prevent the toner from leakage (magnetic seal), as disclosed in U.S. Pat. No. 5,790,923. In order to prevent toner leakage from an opening formed the developing device frame and extended along a longitudinal direction (axial direction of the developing roller) of the developing roller, a sheet is contacted to the developing roller (Japanese Laid-open Patent Application 2000-275965).

FIG. 11 shows an example of the structure of the magnetic seal portion of a conventional developing device. In FIG. 11, designated by 40 is a developing device frame supporting the developing roller, and the opposite longitudinal end portions thereof are provided with magnetic seals 41, 42 mounted thereto, respectively. A longitudinally extending side of the opening of the developing device frame 40 is provided with a flexible sheet 43 stuck thereon by a double-coated tape 44. However, in the developing device having the above-described structure, there is a liability that sealing properties are low at the end portions of the magnetic seal 41 and the sheet 43. More particularly, as shown by an arrow r, the toner may leak through the gap between the magnetic seal 41 and the double coated tape 44 at the back side of the sheet 43. Conventionally, another sealing member has been provided, for example. This would result in increase in cost due to increase of the number of parts and/or the number of assembling steps.

However, in the developing device having the above-described structure, there is a liability that sealing properties are low at the end portions of the magnetic seal 41 and the sheet 43. More particularly, as shown by an arrow r, the toner may leak through the gap between the magnetic seal 41 and the double-coated tape 44 at the back side of the sheet 43. Conventionally, another sealing member has been provided, for example. This would result in increase in cost due to increase of the number of parts and/or the number of assembling steps.

SUMMARY OF THE INVENTION

Accordingly, it is a principal object of the present invention to provide a developing device, a process cartridge and a magnetic sealing member with which the sealing performance against the magnetic developer is improved.

It is another object of the present invention to provide a developing apparatus for an image forming apparatus comprising a developing roller for carrying a magnetic developer; a developing device frame, having an opening for exposing a part of said developing roller, for rotatably supporting said developing roller; a magnetic sealing member, mounted to said developing device frame at a longitudinal end portion, for sealing a gap between said developing device frame and said developing roller against leakage of the magnetic developer, wherein said magnetic sealing member includes an arcuate surface which has a magnetic property and which is opposed to an outer surface of said developing roller with a gap therebetween and a projected surface which has a magnetic property and which is projected from an upstream end of said arcuate surface toward upstream with respect to a peripheral moving direction of said developing roller and which is remoter from an outer surface of said developing roller than said arcuate surface; a sheet for preventing the magnetic developer from leaking through between said developing device frame and said developing roller, said sheet being mounted to an upstream end of said developing device frame with respect to the moving direction and contacted to said developing roller so as to cover at least a part of said projected surface.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

The embodiments of the present invention will be described in conjunction with the accompanying drawings.

(General arrangement of image forming apparatus)

Figure 1:
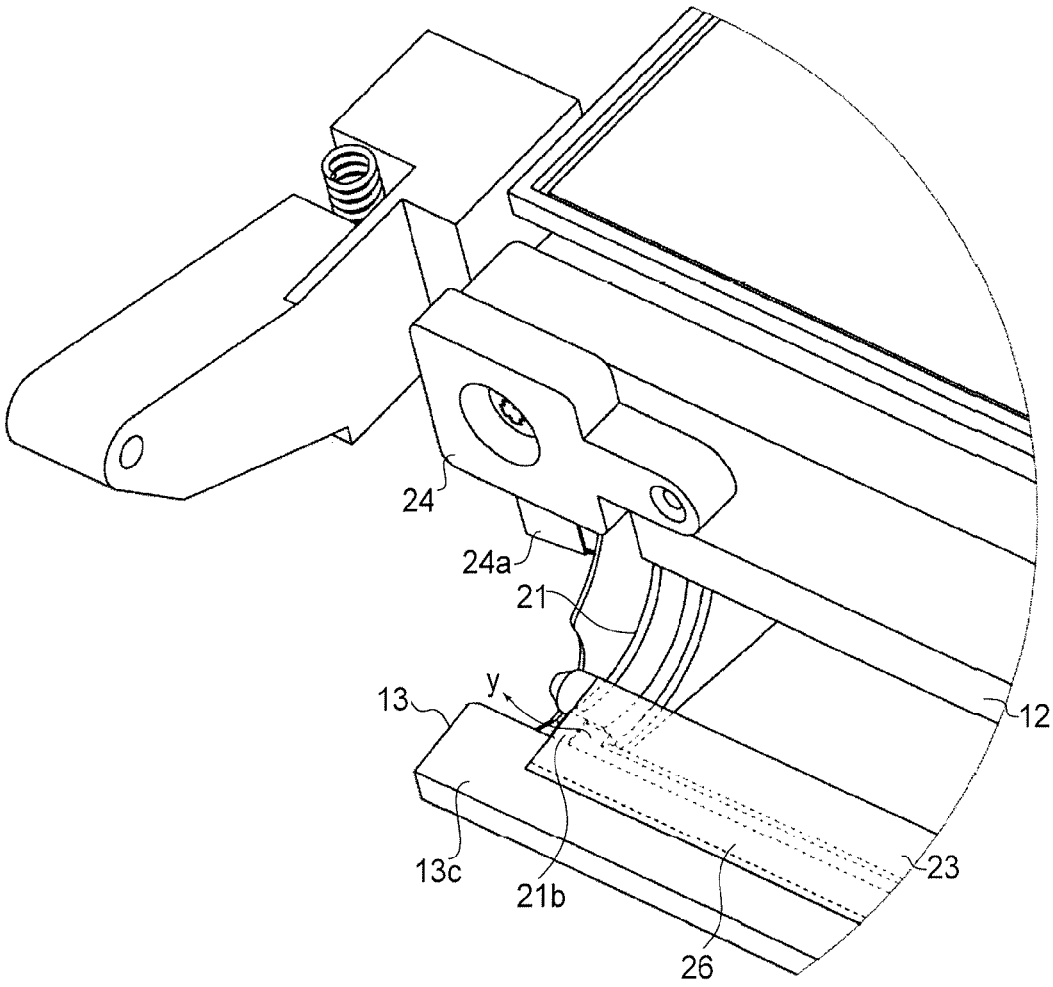
FIG. 1 is a perspective view of a developing unit according to a first embodiment of the present invention.
Figure 2:
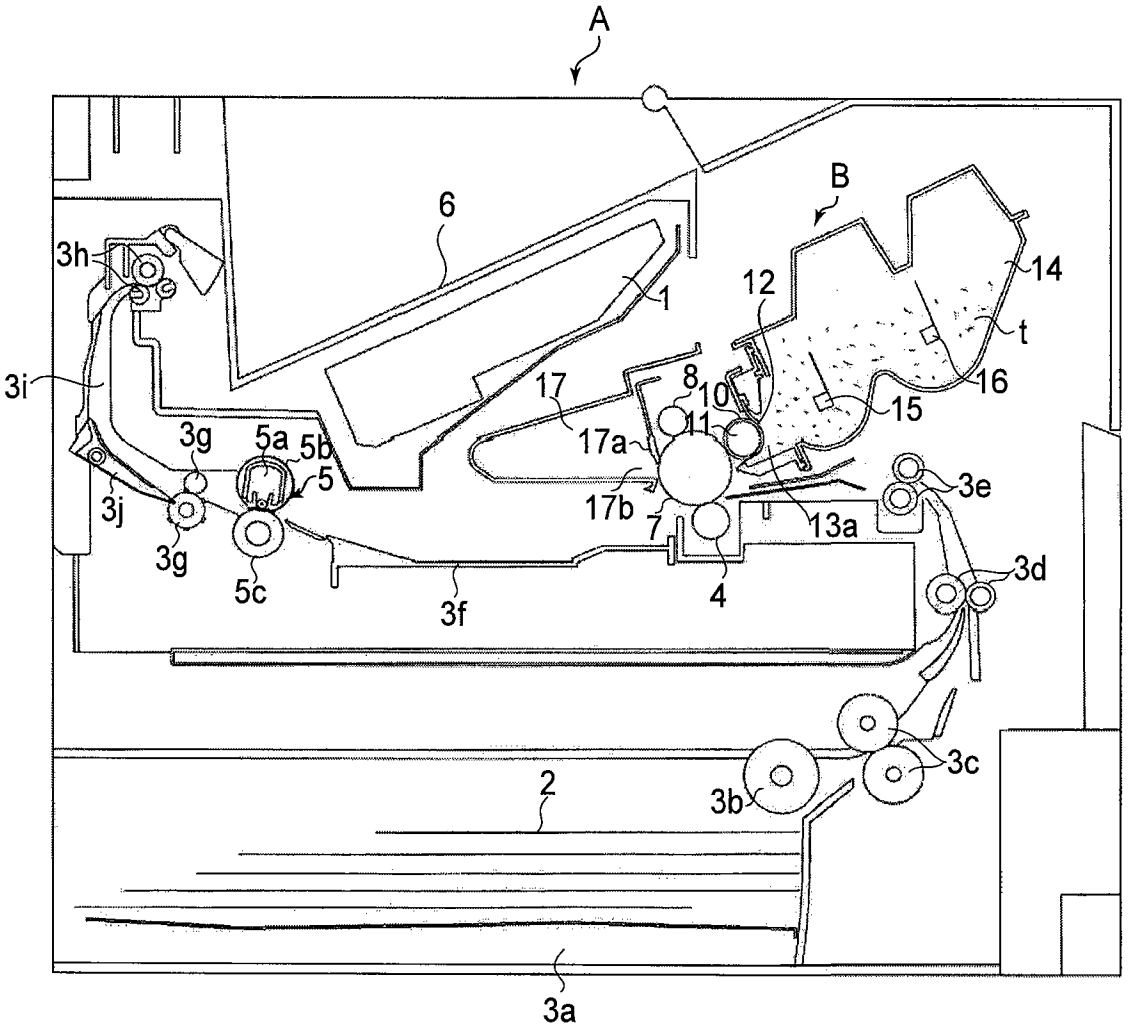
FIG. 2 is a general arrangement of an image forming apparatus according to the first embodiment of the present invention.
Figure 3:
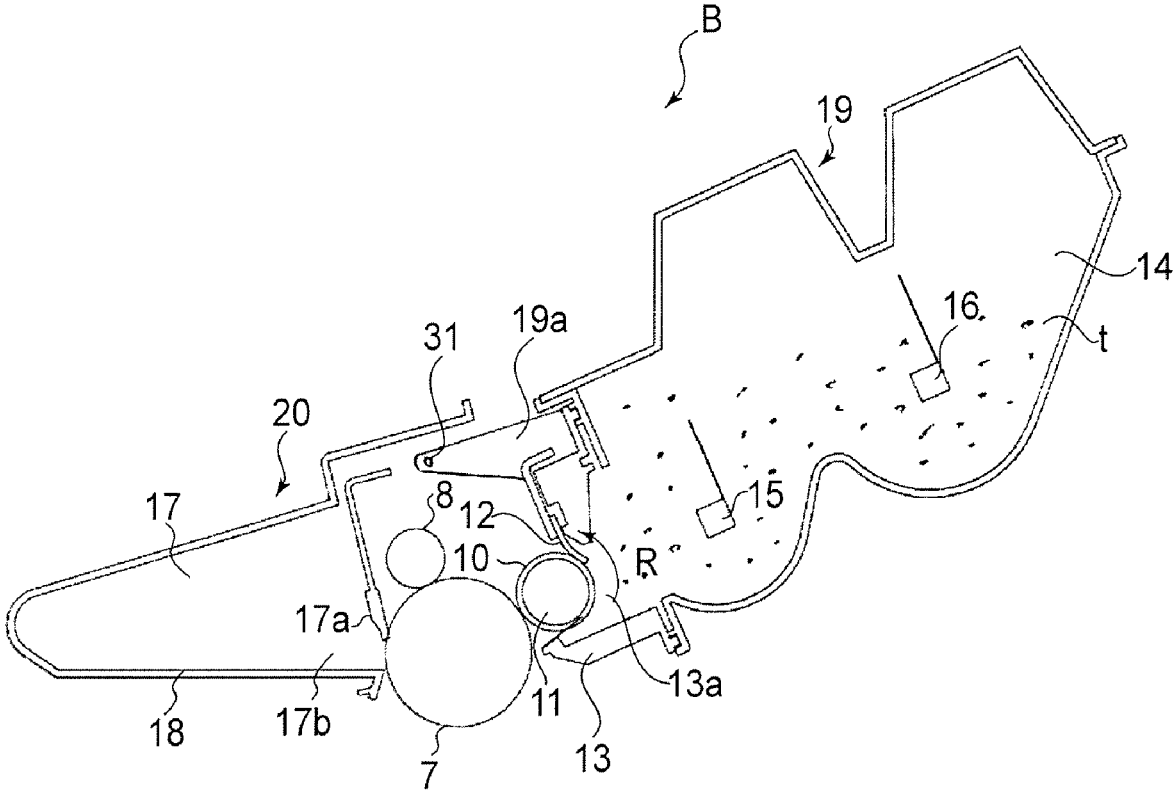
FIG. 3 is a sectional view of a process cartridge according to the first embodiment of the present invention.

Referring to FIGS. 2 and 3, a description will be made as to an image forming apparatus to which a process cartridge according to this embodiment is detachably mountable. FIG. 2 shows a general arrangement of an electrophotographic image forming apparatus according to this embodiment. FIG. 3 is a sectional view of a process cartridge B detachably mountable to the main assembly of the electrophotographic image forming apparatus (main assembly of the apparatus) A according to this embodiment. In this embodiment, the image forming apparatus is an electrophotographic-type, laser beam printer.

The cartridge B comprises an electrophotographic photosensitive member in the form of a drum (photosensitive drum) 7. The cartridge B comprises a developing unit 19 functioning as a developing device.

The image forming apparatus will generally be described in the order of the image forming operation steps. First, a surface of the photosensitive drum 7 is uniformly charged by voltage application to the charging roller 8 functioning as charging means. Then, the photosensitive drum 7 is exposed to a laser beam in accordance with image information supplied from optical means 1 including a laser diode, a polygonal mirror, a lens and reflection mirrors. By doing so, a latent image is formed on the photosensitive drum 7 in accordance with the image information. Thereafter, the latent image is developed by developing means with toner t.

The developing means delivers the toner t accommodated in a toner accommodating container 14 into a developer chamber 13*a* by rotation of toner feeding members 15, 16. The developing roller 10 containing a magnet roller (fixed magnet) 11 therein is rotated. The toner is given triboelectric charge by the developing blade 12, and a toner layer is formed on the surface of the developing roller 10. The toner t is transferred onto the photosensitive drum 7 in accordance with the latent image to form a visualized toner image on the photosensitive drum 7. The developing roller 10 carries the toner t to the opposing region where it is opposed to the photosensitive drum 7. The developing blade 12 has a regulating portion 12*a* made of elastic material (rubber). The regulating portion 12*a* is contacted to the developing roller 10 by which the amount of toner on the peripheral surface of the developing roller 10 can be regulated while applying triboelectric charge to the toner particles.

In synchronism with formation of the toner image, the recording material 2 set in the sheet feeding cassette 3*a* is fed to the transfer position by the pick-up roller 3*b*, the pair of feeding rollers 3*c*, 3*d* and 3*e*. In the transfer position, there is provided transferring means in the form of a transfer roller 4. By application of the voltage to the transfer roller 4, the toner image on the photosensitive drum 7 is transferred onto the recording material 2.

The recording material 2 now having the toner image transferred thereto is fed to the fixing means 5 through the feeding guide 3*f*. The fixing means 5 is provided with the fixing roller 5*b* containing a heater 5*a* and provided with the driving roller 5*c*. By application of heat and pressure by the fixing means 5, the transferred toner image is fixed on the recording material 2. Thereafter, a recording material 2 is fed by a pair of discharging rollers 3*g* and 3*h*, and is discharged to the discharging tray 6. The discharging tray 6 is disposed at the upper surface of upper surface main assembly A of the image forming apparatus. The pick-up roller 3*b*, the pair of feeding rollers 3*c*, 3*d*, and 3*e* a feeding guide 3*f* and the pair of discharging rollers 3*g* and 3*h* and so on constitutes the feeding means 3 for feeding the recording material 2.

After the toner image is transferred onto the recording material 2 by the transfer roller 4, the photosensitive drum 7 is cleaned by the cleaning means 17 removing the toner t therefrom. Then, the photosensitive drum 7 is prepared for the next image forming process operation. The cleaning means 17 comprises an elastic cleaning blade 17*a* and a residual toner container. One end of the cleaning blade 17*a* is contacted to the photosensitive drum 7 to scrape the residual toner off the photosensitive drum 7. The residual toner is collected into the residual toner container 17*b* .

(Process Cartridge)

As shown in FIG. 3, the process cartridge B comprises a developing unit 19 and a drum unit 20.

The drum unit 20 comprises a drum frame 18, a photosensitive drum 7, the charging roller 8 and the cleaning means 17. The photosensitive drum 7, the charging roller 8 and the cleaning means 17 are supported by the drum frame 18.

The developing unit 19 contains the developing roller 10, which will be described hereinafter.

The developing unit 19 and the drum unit 20 are rotatably connected with each other by a pin 31. An elastic member (unshown) is provided between the units 19 and 20 to urge the developing roller 10 to the photosensitive drum 7. Designated by 19*a* is an arm portion provided in the developing unit 19. The arm portion 19*a* is engaged with the drum unit 20 by the pin 31 engaged through the arm portion 19*a* and the drum unit 20.

(Developing Unit)

Figure 4:
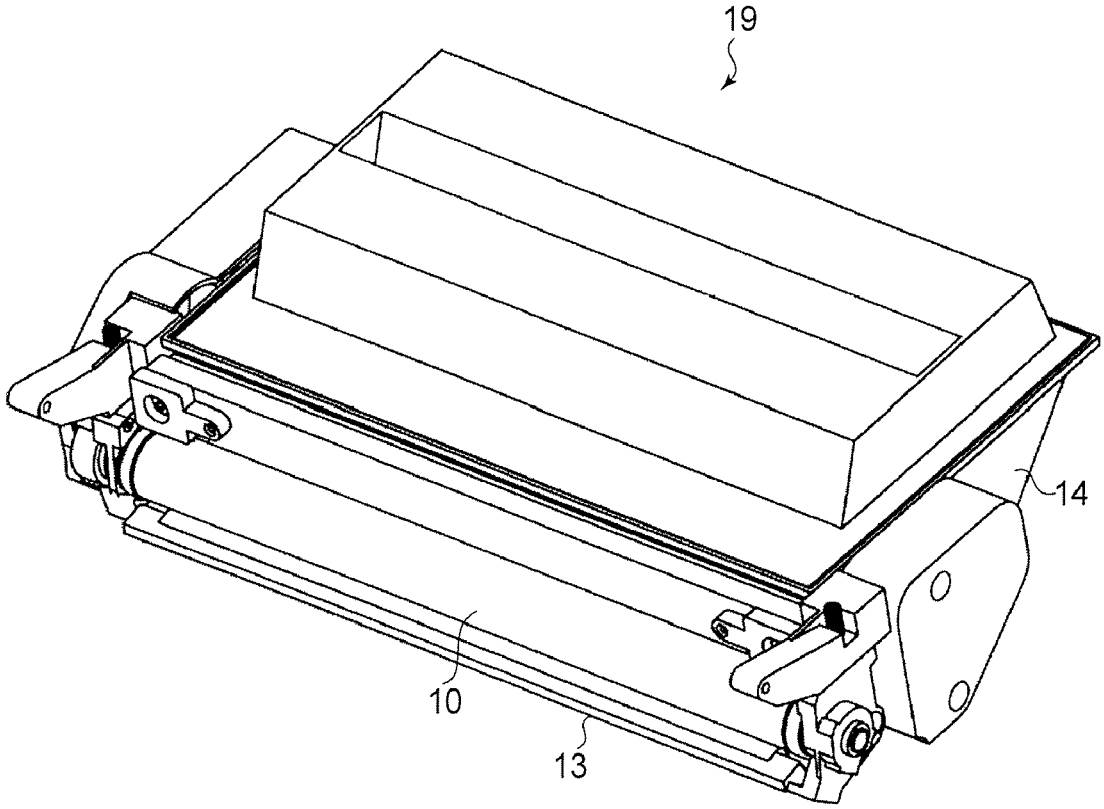
FIG. 4 is a perspective view of a developing unit according to the first embodiment of the present invention.

The structure of the developing unit 19 will be described. FIG. 4 is a perspective view of the developing unit 19. As shown in FIG. 4, the developing unit 19 comprises the developing device frame 13 and the toner accommodating container 14. The developing device frame 13 rotatably supports the developing roller 10. On the other hand, the toner accommodating container 14 accommodates the toner t.

Figure 5:
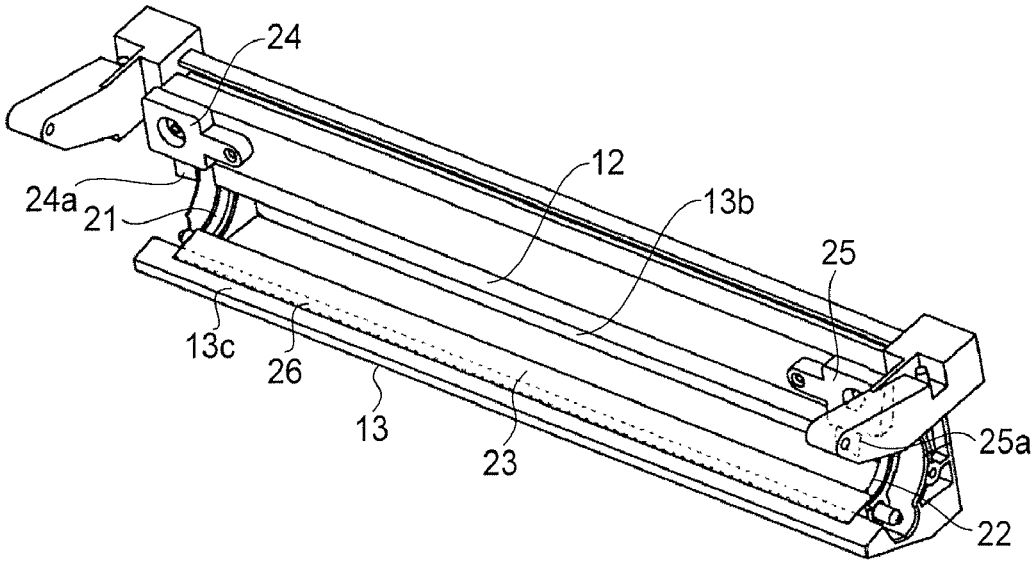
FIG. 5 is a perspective view of a developing device frame according to the first embodiment of the present invention.

FIG. 5 is a perspective view of the developing device frame 13. As shown in FIG. 5, the developing device frame 13 is provided with an opening 13*b* for exposing a part of the developing roller 10. The opening 13*b* is open to feed the toner t from the inside of the developing device frame 13 to the photosensitive drum 7. The opening 13 is generally rectangular in shape.

At each of one end portion and the other end portion, with respect to the longitudinal direction, of the opening 13*b*, there is provided a magnetic sealing member 21, 22. The magnetic sealing member 21, 22 is effective to prevent the toner t from leaking between the developing device frame 13 and the developing roller 10 along the longitudinal direction of the developing roller 10. That is, the sealing member 21, 22 seals between the developing device frame 13 and the developing roller 10 against the toner t.

The lower side portion of the opening 13*b* is provided with a mounting portion 13*c* extending over the length of the opening 13*b*. The mounting portion 13*c* is disposed at an upstream end of the developing device frame 13 with respect to the peripheral movement of the surface of the developing roller 10 (FIG. 3). A sheet 23 is mounted to the mounting portion 13*c* as shown by a double-coated tape 26 (broken line in FIG. 5). The sheet 23 is contacted to the developing roller 10 mounted to the developing device frame 13 with a low pressure. By doing so, the sheet 23 prevents leakage of the toner t between the lower side portion of the developing roller 10 and the mounting portion 13*c*. In this embodiment, the sheet 23 is a PET sheet having a thickness of 50 μm. In this embodiment, one lateral end portion of the sheet 23 is fixed on the mounting portion 13, and the other lateral end portion of the sheet 23 is contacted to the developing roller 10. A direction from said one lateral end portion of the sheet 23 toward said other end portion thereof is codirectional with the peripheral moving direction of the surface of the developing roller 10.

The above-described developing blade 12 extends over the length of the opening 13*b*. The developing blade 12 is disposed at the downstream end of the developing device frame 13 with respect to the peripheral moving direction of the surface of the developing roller 10.

Scraping and gathering members 24 and 25 are mounted on the developing device frame 13 with the developing blade 12 therebetween. The scraping and gathering members 24, 25 are disposed at the downstream end of the developing device frame 13 with respect to the peripheral moving direction of the surface of the developing roller 10. In other words, the scraping and gathering members 24, 25 are provided adjacent the downstream end of the arcuate surface 21*a* (downstream of the downstream end of the arcuate surface 21*a*) with respect to the peripheral moving direction of the surface of the developing roller 10. The scraping and gathering members 24, 25 have respective scraping and gathering portions 24*a*, 25*a* which are thin and which have been molded to have a portion inclined toward inside. The scraping and gathering portions 24*a*, 25*a* are contacted to the outer surface of the developing roller 10. By this arrangement, the toner t deposited on the surface of the developing roller 10 is collected to the longitudinal inside of the developing roller 10.

(Magnetic sealing member)

Figure 6:
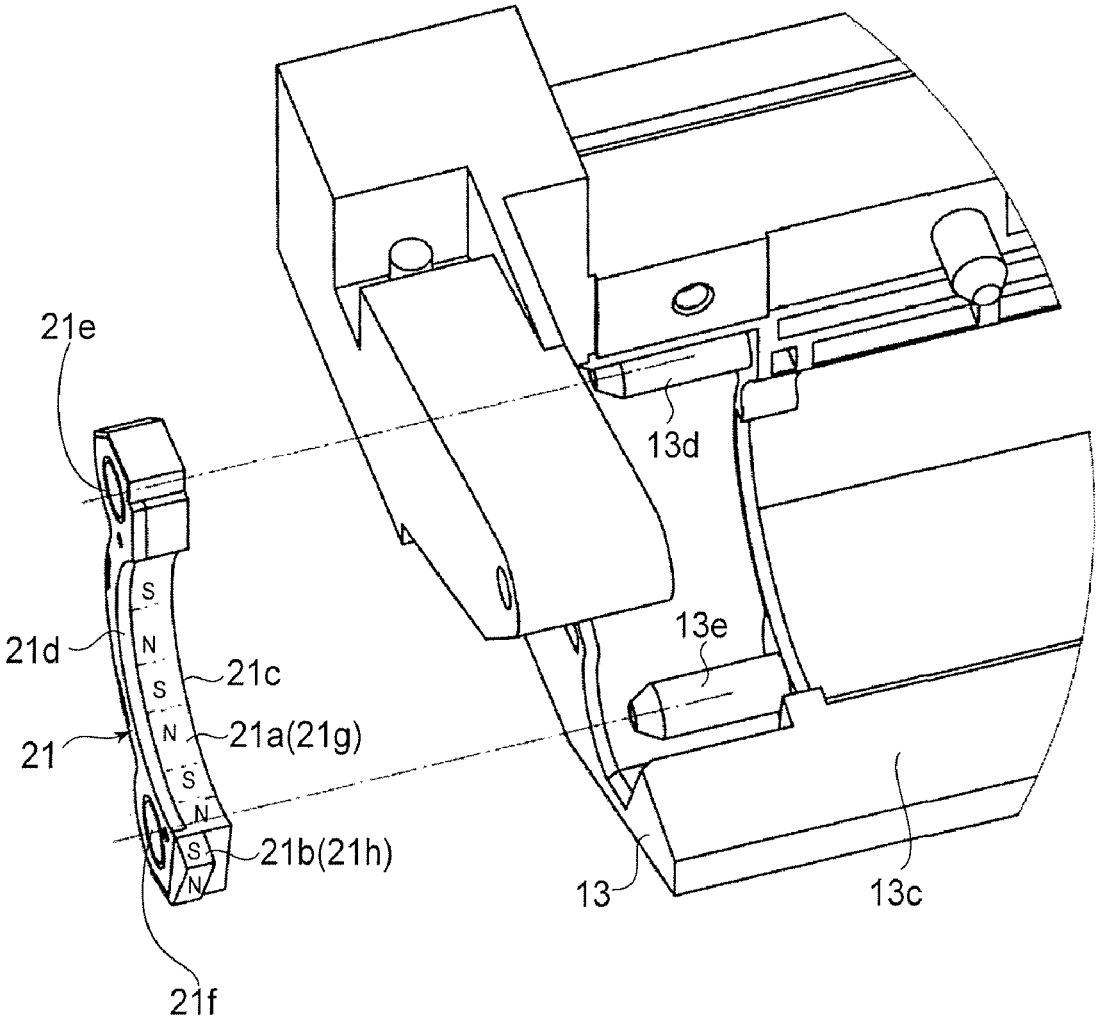
FIG. 6 illustrates structures of a magnetic sealing member and a developing device frame according to the first embodiment of the present invention.

As shown in FIG. 6, the magnetic sealing member 21 is in the form of an integrally molded member including a magnet 21*c* and a metal plate 21*d* of magnetic material. The metal plate 21*d* is effective to converge the magnetic force lines from the magnet 21*c*. By this arrangement, the toner t scattering toward longitudinally outside of the developing roller 10 is suppressed. The magnetic sealing member 21 has an arcuate portion 21*g* and a projected portion 21*h*. Here, a surface 21*a* of the arcuate portion 21*g* opposed to the developing roller 10 is called arcuate surface, and a surface 21*b* of the projected portion 21*h* opposed to the developing roller 10 is called projected surface. The arcuate surface 21*a* and the projected surface 21*b* both have magnetic property. The arcuate surface 21*a* is provided with a plurality of magnetic poles arranged along the peripheral moving direction of the surface of the developing roller 10, and the projected surface 21*b* is provided with a magnetic pole. The arcuate surface 21*a* is opposed to the outer surface of the developing roller 10 with a fine clearance therebetween. The projected surface 21*b* is projected toward upstream from the upstream end of the arcuate surface 21*a* with respect to the peripheral moving direction of the surface of the developing roller 10. The projected surface 21*b* is remoter from the outer surface of the developing roller 10 than the arcuate surface 21*a*. The gap between the projected surface 21*b* and the outer surface of the developing roller 10 increases with increase of the distance from the arcuate surface 21*a* with respect to the peripheral moving direction.

(Mounting of Magnetic Sealing Member to Developing Device Frame)

The end, with respect to the longitudinal direction of the developing roller 10, of the developing device frame 13 is provided with bosses 13*d*, 13*e*. Here, the bosses 13*d*, 13*e* are projected longitudinally outwardly of the developing roller 10 from ends of the developing device frame 13. On the other hand, the magnetic sealing member is provided with hole portions 21*e*, 21*f*. When magnetic sealing member 21 is mounted to the developing device frame 13, the magnetic sealing member 21 is moved from outside to inside of the developing roller 10, and the hole portions 21*e* 21*f* are engaged with the bosses 13*d* 13*e*.

(Positional Relation Among Magnetic Sealing Member, Sheet and Toner Scraping and Gathering Member)

Figure 7:
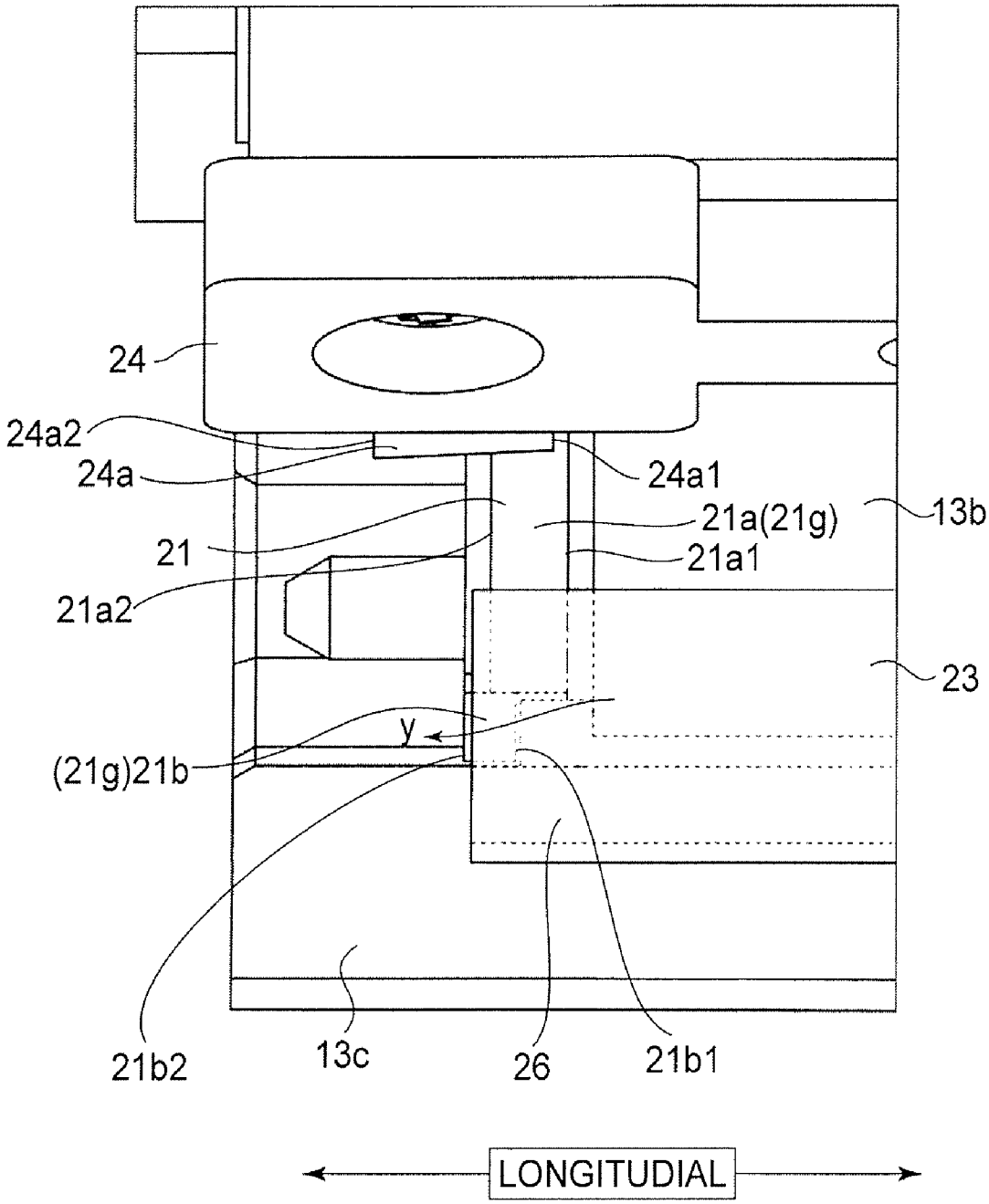
FIG. 7 illustrates a structure of a developing unit according to the first embodiment of the present invention.
Figure 8:
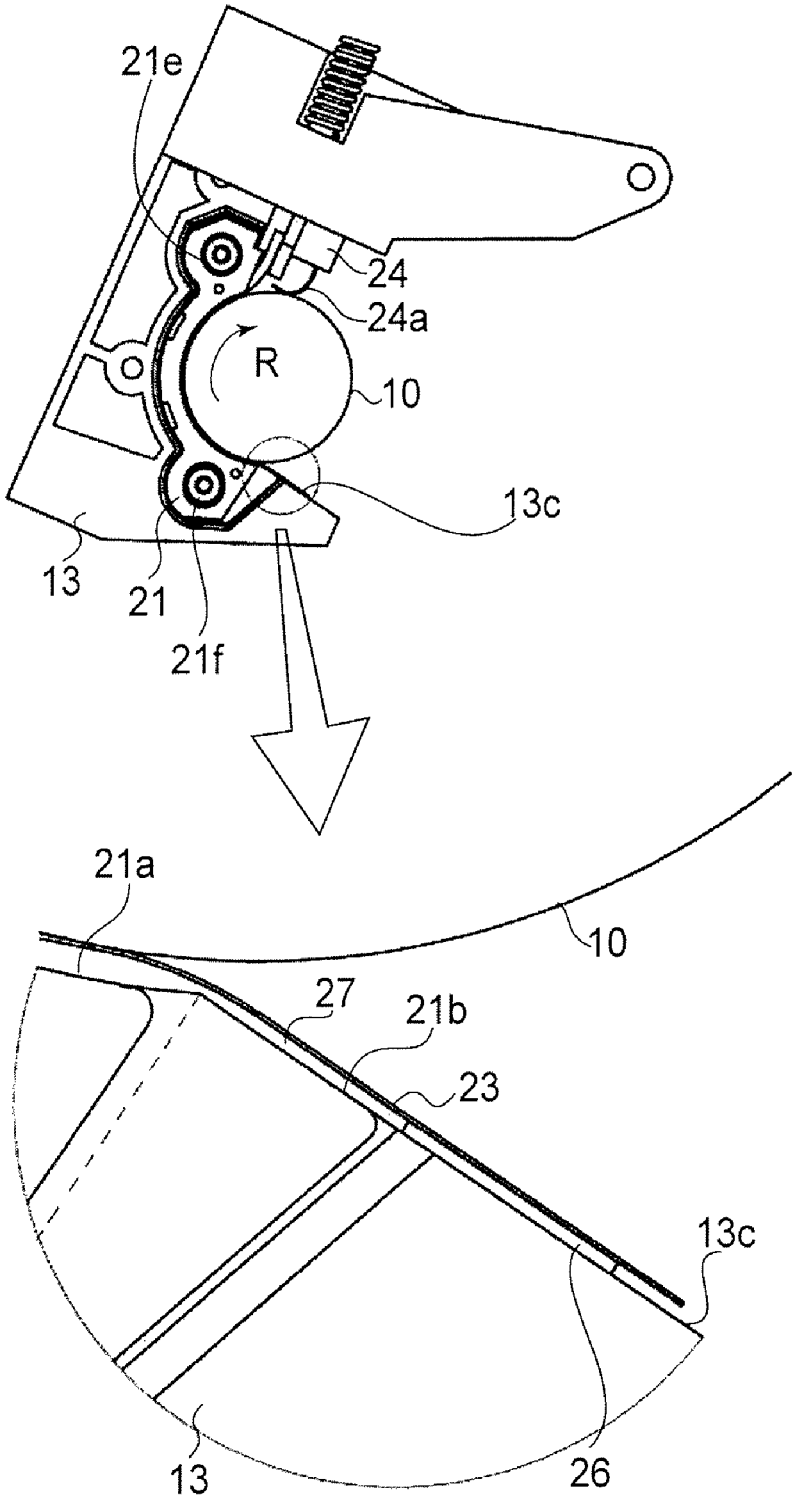
FIG. 8 illustrates a structure of a developing unit according to the first embodiment of the present invention.

Referring to FIGS. 7 and 8, a description will be made as to the arrangement of the magnetic sealing member 21, the sheet 23 and a toner scraping and gathering member 24. FIG. 7 shows a positional relation among the magnetic sealing member 21, the sheet 23 and the toner scraping and gathering member 24 and so on. FIG. 8 is a view as seen from the side surface to which the magnetic sealing member 21 is mounted to the developing device frame 13 (parallel with the longitudinal direction of the developing roller 10).

(Positional relation between and sheet and the magnetic sealing member)

As shown in FIG. 7, sheet 23 is mounted to the mounting portion 13*c* such that at least a part of the sheet 23 covers at least a part of the projected surface 21*b*. By this arrangement, the toner t existing between the projected surface 21*b* and the sheet 23 can be retained by the magnetic force of the projected surface 21*b*. The magnetic force of the projected surface 21*b* is effective to prevent the toner t tending to leak in the direction of arrow y between the sheet 23 and the developing device frame 13 (reference numeral 27 in FIG. 8). Thus, the leakage of the toner t from the developing device frame 13 toward the outside can be suppressed. As shown in FIG. 8, the mounting portion 13*c* is provided to the upstream end of the developing device frame 13 with respect to the peripheral moving direction of the surface of the developing roller 10. In other words, the mounting portion 13*c* is disposed upstream of the projected surface 21*b* with respect to the peripheral moving direction of the developing roller 10.

As shown in FIG. 7, the area of the projected surface 21*b* is within the region of the sheet 23. At least a part of the double-coated tape 26 overlaps with at least a part the projected surface 21*b* in the longitudinal direction of the developing roller 10.

The sheet 23 covers at least an inside portion of the projected surface 21*b* with respect to the longitudinal direction of the developing roller 10.

The sheet covers a part of the arcuate surface 21*a*.

As shown in FIG. 8, the projected surface 21*b* is substantially flush with the mounting portion 13*c*. By this arrangement, the sheet 23 can be mounted to the substantially common flat surface, and therefore, the waving of the sheet 23 can be suppressed. Thus, the leakage of the toner t can be further suppressed.

The projected surface 21*b* is required to produce a force enough to prevent the toner leakage. If a volume of magnet of the projected portion 21*h* is too small, the intensity of the pole magnetizable in the projected surface 21*b* may not be large enough to prevent the toner leakage. In view of this, in this embodiment, as shown in FIG. 6, the metal plate 21*d* is not disposed on the side surface of the projected portion 21*h* (the metal plate 21*d* is disposed only on the side surface of the arcuate portion 21*g*), so that enough volume for the magnet of the projected portion 21*h* is assured. If, however, the magnetic force of the projected surface 21*b* is large enough to prevent the toner leakage despite the metal plate 21*d* being disposed on the side surface of the projected portion 2l*h*, this structure is unnecessary.

(Positional Relation Between Scraping and Gathering Portion and Projected Surface)

As shown in FIG. 7, the inside end 21*b*1 of the projected surface 21*b* is disposed such that it is outside the inside end 24*a*1 of the scraping and gathering portion 24*a* with respect to the longitudinal direction of the developing roller 10. By doing so, the toner t is not fed to the surface of the developing roller 10 in the region of the projected surface 21*b*. Therefore, the toner t fed on the developing roller 10 can be suppressed from stagnating on the sheet 23 by the magnetic force of the projected surface 21*b* and then falling therefrom. In other words, the deposition of the toner t on the developing roller can be suppressed in the range of the projected surface 21*b* with respect to the longitudinal direction of the developing roller 10 and in the range downstream of the scraping and gathering portion 24*a* with respect to the peripheral moving direction of the developing roller 10 and upstream of the projected surface 21*b*. Therefore, a toner layer is hardly formed in the range. On the other hand, the outer end 21*b*2 of the projected surface 21*b* is disposed inside the outer end 24*a*2 of the scraping and gathering portion 24*a* with respect to the longitudinal direction of the developing roller 10.

(Positional Relation Between Scraping and Gathering Portion and Arcuate Surface)

Figure 9:
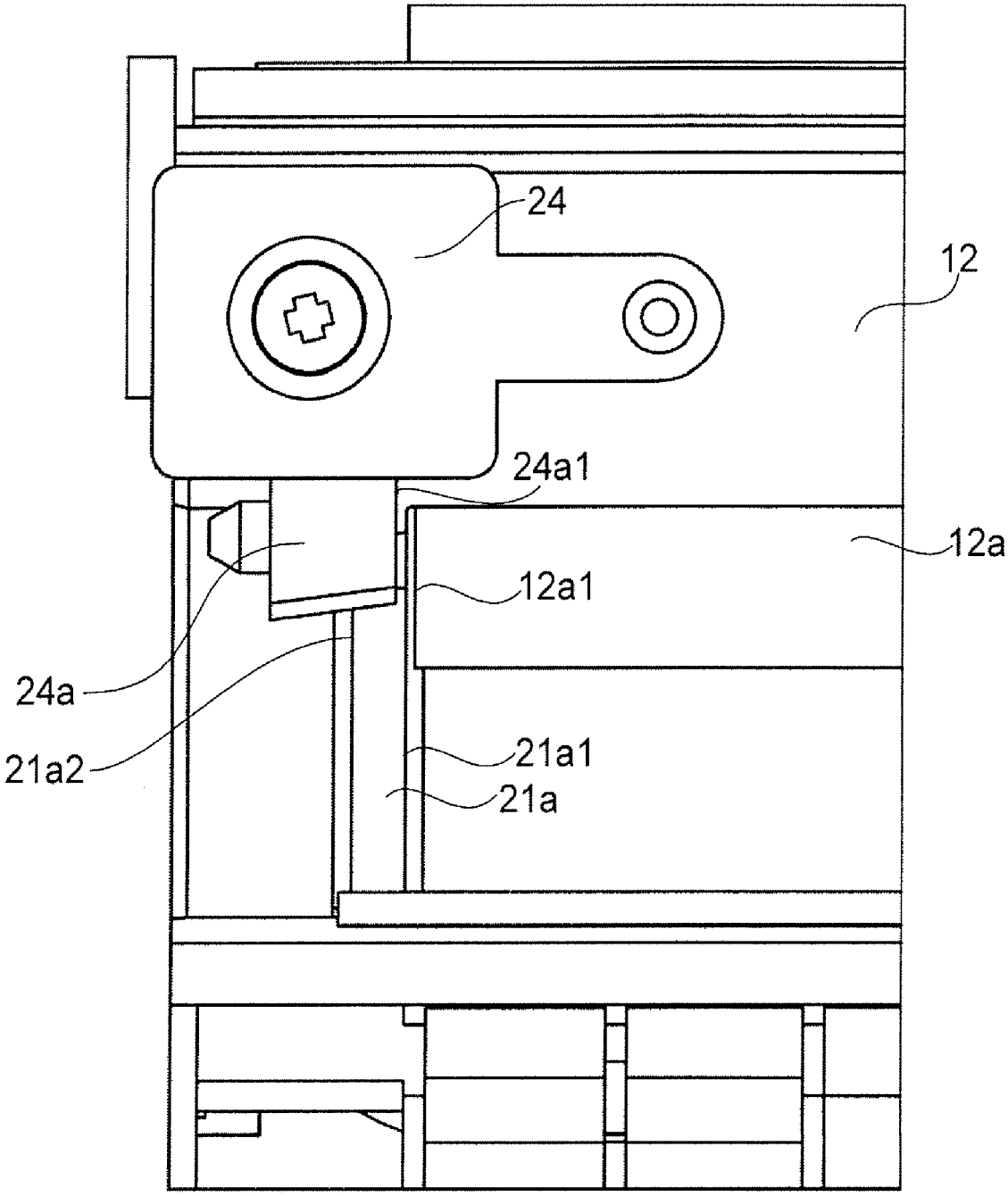
FIG. 9 illustrates a structure of a developing unit according to the first embodiment of the present invention.

As shown in FIG. 7, the inside end 21*a*1 of the arcuate surface 21*a* is disposed inside the inside end 24*a*1 of the scraping and gathering portion 24*a*. As shown in FIG. 9, the inside end 21*a*1 of the arcuate surface 21*a* is disposed between the end 12*a*1 of the regulating portion 12*a* of the developing blade 12 and the inside end 24*a*1 thereof. By this arrangement, the overflow of the toner t can be suppressed between the end 12*a*1 and the inside end 24*a*1. The outer end. 21*a*2 of the arcuate surface 21*a* is disposed inside the outer end 24*a*2 of the scraping and gathering portion 24*a* with respect to the longitudinal direction of the developing roller 10.

(Positional Relation Between Projected Surface and Arcuate Surface)

With respect to the longitudinal direction of the developing roller 10, the inside end 21*b*1 of the projected surface 21*b* is disposed outside the inside end 21*a*1 of the arcuate surface 21*a*. Furthermore, with respect to the longitudinal direction of the developing roller 10, the outer end 21*b*2 of the projected surface 21*b* is disposed outside the outer end 21*a*2 of the arcuate surface 21*a*.

According to this embodiment, the sealing performance of the magnetic developer can be improved.

Embodiment 2

A description will be made as to the second embodiment of the present invention. In the description of this embodiment, the same reference numerals as in Embodiment 1 are assigned to the elements having the corresponding functions in this embodiment, and the detailed description thereof is omitted for simplicity.

Figure 10:
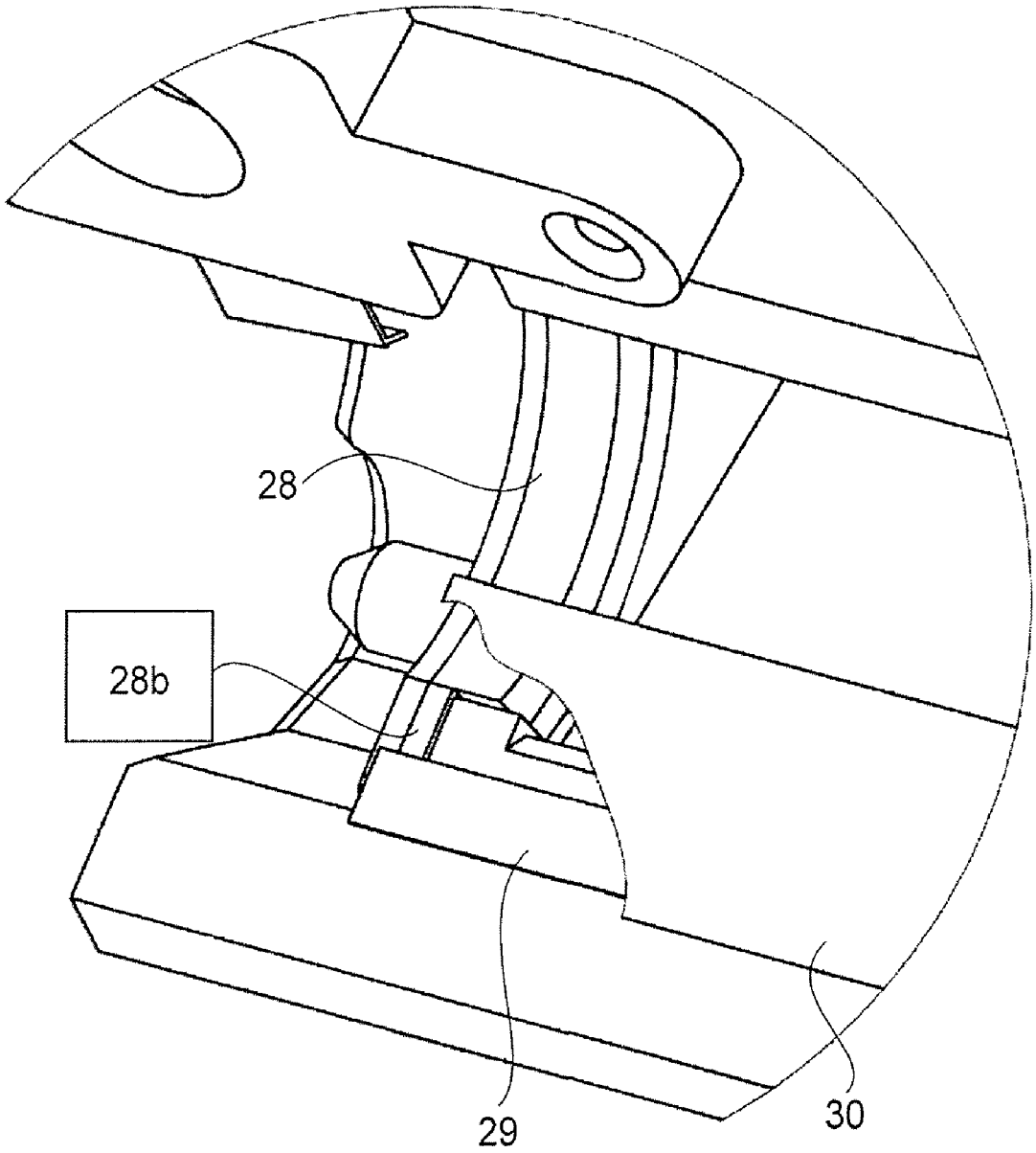
FIG. 10 illustrates a structure of a developing unit according to a second embodiment of the present invention.
Figure 11:
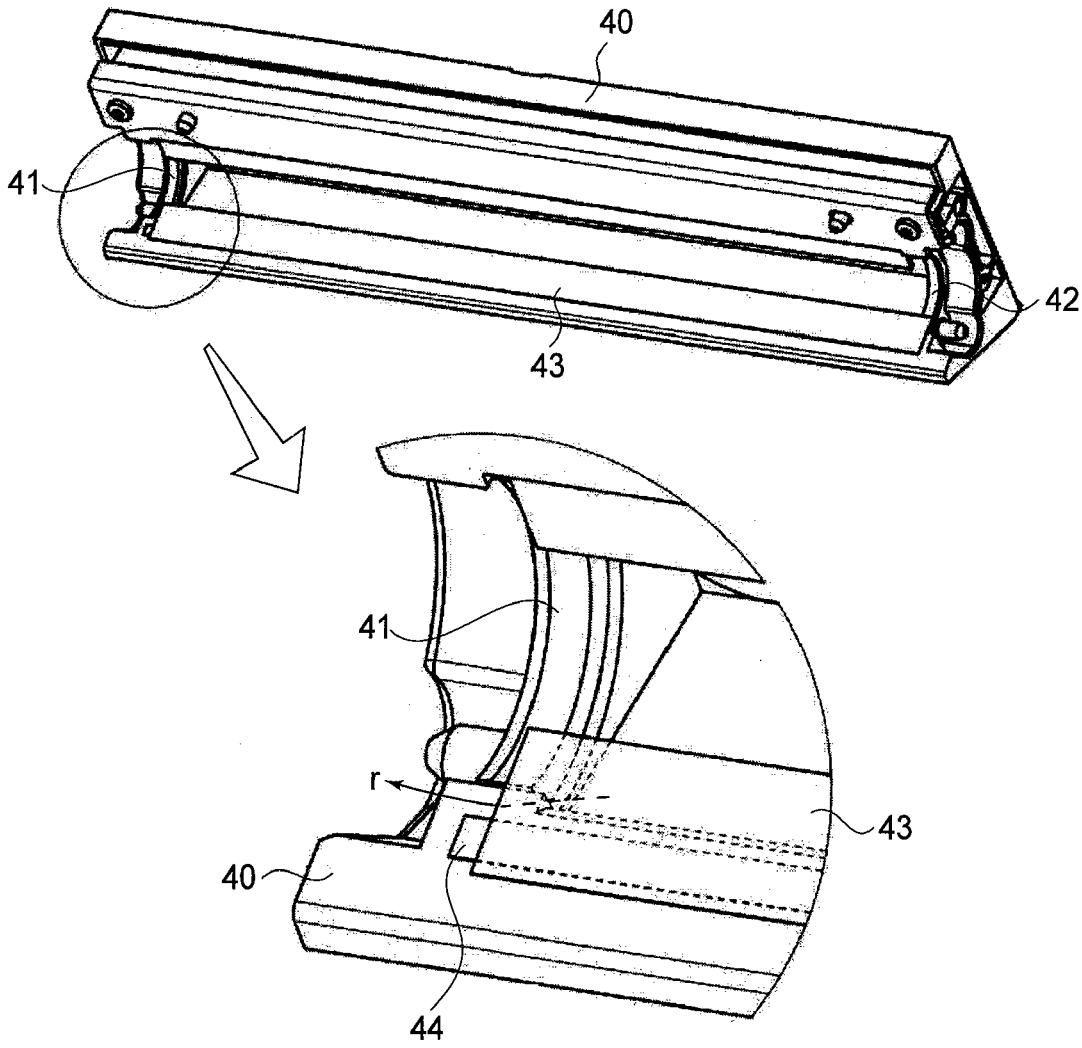
FIG.11 PRIOR ART
FIG. 11 shows a conventional developing device frame.

In this embodiment, as shown in FIG. 10, a double-coated tape 29 (bonding member) is stuck so as to cover a part of the projected surface 28*b* of the magnetic sealing member 28. The sheet 30 is stuck so as to cover the projected surface 28*b* similarly to the first embodiment. By this arrangement, no gap is formed at the boundary portion between the developing device frame 13 and the projected surface 28*b*, and therefore, the leakage of the toner t can be suppressed. Since the double-coated tape 29 for mounting the sheet 30 to the developing device frame 13 bonds a part of the projected surface 28*b*, no gap is formed between the magnetic sealing member 28 and the sheet 30. Therefore, the leakage of the toner t can be suppressed more assuredly. With such a structure, the magnetic sealing member 28 can be fixed to the developing device frame 13, and therefore, no additional fixing means is required.

In the above-described Embodiments 1 and 2, a description has been made as to the case that cartridge B has a developing device in the form of a developing unit 19, but the present invention is not limited to such a case and is applicable to the case that developing unit 19 is mounted directly to the main assembly A of the apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 309230/2006 filed Nov. 15, 2006, which is hereby incorporated by reference.

What is claimed is:

1. A developing apparatus for an image forming apparatus comprising:

a developing roller for carrying a magnetic developer;

a developing device frame, having an opening for exposing a part of said developing roller, for rotatably supporting said developing roller;

a magnetic sealing member, mounted to said developing device frame at a longitudinal end portion, for sealing a gap between said developing device frame and said developing roller against leakage of the magnetic developer, wherein said magnetic sealing member includes an arcuate surface which has a magnetic property and which is opposed to an outer surface of said developing roller with a gap therebetween and a projected surface which has a magnetic property and which is projected from an upstream end of said arcuate surface toward upstream with respect to a peripheral moving direction of said developing roller and which is more remote from an outer surface of said developing roller than said arcuate surface; and a sheet for preventing the magnetic developer from leaking through between said developing device frame and said developing roller, said sheet being mounted to an upstream end of said developing device frame with respect to the moving direction and contacted to said developing roller so as to cover at least a part of said projected surface.

2. The developing apparatus according to claim 1, further comprising a scraping and gathering portion, contacted to said developing roller and disposed downstream of a downstream end of said arcuate surface with respect to the moving direction and upstream of said projected surface with respect to the moving direction, for scraping and gathering the magnetic developer deposited on said developing roller longitudinally toward an inside direction, wherein a longitudinal inside end of said projected surface is disposed outside a longitudinal inside end of said scraping and gathering portion with respect to a longitudinal direction of said developing roller.

3. The developing apparatus according to claim 2, wherein a longitudinal inside end of said arcuate surface is disposed inside of a the longitudinal inside end of said scraping and gathering portion with respect to a longitudinal direction of said developing roller.

4. The developing apparatus according to claim 1, wherein said sheet covers an inside portion of said projected surface with respect to a longitudinal direction of said developing roller.

5. The developing apparatus according to claim 1, wherein said sheet covers a part of said arcuate surface.

6. The developing apparatus according to claim 1, wherein said sheet is bonded to said projected surface.

7. A process cartridge detachably mountable to a main assembly of an image forming apparatus, the process cartridge comprising:

an electrophotographic photosensitive member;

a developing roller for carrying a magnetic developer to develop an electrostatic latent image formed on said electrophotographic photosensitive member;

a developing device frame, having an opening for exposing a part of said developing roller, for rotatably supporting said developing roller;

a magnetic sealing member, mounted to said developing device frame at a longitudinal end portion of said developing roller, for sealing a gap between said developing device frame and said developing roller against leakage of the magnetic developer, wherein said magnetic sealing member includes an arcuate surface which has a magnetic property and which is opposed to an outer surface of said developing roller with a gap therebetween and a projected surface which has a magnetic property and which is projected from an upstream end of said arcuate surface toward upstream with respect to a peripheral moving direction of said developing roller and which is more remote from an outer surface of said developing roller than said arcuate surface; and a sheet for preventing the magnetic developer from leaking through between said developing device frame and said developing roller, said sheet being mounted to an upstream end of said developing device frame with respect to the moving direction and contacted to said developing roller so as to cover at least a part of said projected surface.

8. A magnetic sealing member for mounting to a developing device frame to seal a gap between the developing device frame and a developing roller against leakage of a magnetic developer at a longitudinal end portion of the developing roller, the magnetic sealing member comprising:

an arcuate surface which has a magnetic property and which is opposed to an outer surface of said developing roller with a gap therebetween in a state that magnetic sealing member is mounted to said developing device frame; and a projected surface which has a magnetic property and which is provided at an upstream end of said arcuate surface with respect to a peripheral moving direction of the developing roller and which is more remote from an outer surface of the developing roller than said arcuate surface, in the state that the magnetic sealing member is mounted to the developing device frame, wherein at least a part of said projected surface is covered by a sheet mounted to the developing device frame and contacted to the developing roller.

9. The magnetic sealing member according to claim 8, wherein a longitudinal inside end of said projected surface is outside a longitudinal inside end of said arcuate surface with respect to a longitudinal direction of the developing roller.

* * * * *